US009029763B2

(12) United States Patent
Ugarov

(10) Patent No.: US 9,029,763 B2
(45) Date of Patent: May 12, 2015

(54) ION DEFLECTION IN TIME-OF-FLIGHT MASS SPECTROMETRY

(71) Applicant: Agilent Technologies, Inc., Loveland, CO (US)

(72) Inventor: Michael Ugarov, Loveland, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/015,694

(22) Filed: Aug. 30, 2013

(65) Prior Publication Data

US 2015/0060656 A1 Mar. 5, 2015

(51) Int. Cl.
*H01J 49/40* (2006.01)
*H01J 49/06* (2006.01)

(52) U.S. Cl.
CPC ..... *H01J 49/061* (2013.01); *H01J 49/40* (2013.01)

(58) Field of Classification Search
CPC ..... H01J 49/40; H01J 49/401
USPC ..... 250/287, 282
See application file for complete search history.

(56) References Cited

U.S. PATENT DOCUMENTS 5,614,711 A * 3/1997 Li et al. ..... 250/287
6,037,586 A 3/2000 Baril
6,489,610 B1 12/2002 Barofsky et al.
6,512,225 B2 1/2003 Vestal et al.
6,534,764 B1 3/2003 Verentchikov et al.
6,621,074 B1 9/2003 Vestal
6,661,001 B2 12/2003 Park
6,664,545 B2 12/2003 Kimmel et al.
7,196,324 B2 3/2007 Verentchikov
7,405,394 B2 7/2008 Ono et al.
7,579,586 B2 8/2009 Bowdler et al.
7,709,789 B2 5/2010 Vestal et al.
7,777,180 B2 8/2010 Hill, Jr. et al.
7,838,824 B2 11/2010 Vestal
7,932,491 B2 4/2011 Vestal
8,258,468 B2 9/2012 Wu
2006/0138316 A1 6/2006 Seydoux et al.
2009/0283670 A1* 11/2009 Koo et al. ..... 250/282
2010/0301202 A1 12/2010 Vestal
2011/0049350 A1 3/2011 Vestal
2013/0161506 A1* 6/2013 Ugarov ..... 250/282
2013/0327935 A1* 12/2013 Wiedenbeck ..... 250/282

OTHER PUBLICATIONS

Brenton et al. 'Improvement of the Duty Cycle of an Orthogonal Acceleration Time-of-Flight Mass Spectrometer Using Ion Gates', 2007, Rapid Comm. in Mass Spec., vol. 21, pp. 3093-3102.*
Schey, et al.; A tandem time-of-flight mass spectrometer for surface-induced dissociation; International Journal of Mass Spectrometry and Ion Processes; Jul. 1, 1987 v.77, No. 1, pp. 49-61.

(Continued)

*Primary Examiner* — Michael Logie
*Assistant Examiner* — Eliza Osenbaugh-Stewart

(57) ABSTRACT

A time-of-flight mass spectrometry (TOF MS) system includes an ion deflector, ion extractor, a flight tube, and a detector. The deflector may be disposed in the flight tube or outside the flight tube upstream of the extractor. The deflector deflects ions away from a main flight path such that the defected ions are not detected.

20 Claims, 4 Drawing Sheets

(56) References Cited

OTHER PUBLICATIONS

Niehuis, et al.; Surface and trace analysis by high-resolution time-of-flight secondary ion mass spectrometry; Journal of Vacuum Science & Technology A (Vacuum, Surfaces, and Films), May-Jun. 1989; v7, No. 3, pt. 2 p. 1823-8.

Petty, et al.; Time-of-flight analyzer for ion end loss of a mirror plasma; Review of Scientific Instruments, Apr. 1988; v. 59, No. 4, pp. 601-604.

Vlasak, et al.; An interleaved comb ion deflection gate for m/z selection in time-of-flight mass spectrometry; Review of Scientific Instruments; Jan. 1996; v. 67, Issue 1; pp. 68-72.

* cited by examiner

ION DEFLECTION IN TIME-OF-FLIGHT MASS SPECTROMETRY

TECHNICAL FIELD

The present invention relates generally to time-of-flight mass spectrometry, and more specifically to deflecting ions in conjunction with time-of-flight mass spectrometry.

BACKGROUND

A mass spectrometry (MS) system in general includes an ion source for ionizing components of a sample of interest, a mass analyzer for separating the ions based on their differing mass-to-charge ratios (or m/z ratios, or more simply "masses"), an ion detector for counting the separated ions, and electronics for processing output signals from the ion detector as needed to produce a user-interpretable mass spectrum. Typically, the mass spectrum is a series of peaks indicative of the relative abundances of detected ions as a function of their m/z ratios. The mass spectrum may be utilized to determine the molecular structures of components of the sample, thereby enabling the sample to be qualitatively and quantitatively characterized.

A time-of-flight mass spectrometer (TOF MS) utilizes a high-resolution mass analyzer (TOF analyzer). Ions may be transported from the ion source into the TOF entrance region through a series of ion guides and ion lenses. The TOF analyzer includes an ion extractor (or pulser) that extracts ions in pulses (or packets) into an electric field-free flight tube. In the flight tube, ions of differing masses travel at different velocities and thus separate (spread out) according to their differing masses, enabling mass resolution based on time-of-flight.

Ions are pulsed out from the extractor at a certain frequency such as, for example, 5 to 20 kHz. A problem with this arrangement relates to the ions that arrive at the extractor between the extraction pulses. The velocity of the ions is such that many of them fly through the extractor long before the next pulse into the flight tube occurs, and as a result these ions are lost. That is, these ions are not injected into the flight tube and thus are not detected, and thus do not contribute to the ion signal utilized to produce a mass spectrum of the sample under analysis. This effect is often referred to as the "low duty cycle" associated with TOF acquisition.

Various methods have been taken to mitigate this effect. In one method, ions are trapped by ion optics preceding the TOF extractor. The trapped ions are released at specific points in time correlated with the extraction pulse sequence. While improving the duty cycle, this method suffers from problems such as reduced mass discrimination, reduced dynamic range, and trap space-charge limits.

Another family of techniques relies on multiplexing (or "multi-pulsing," or "over-pulsing"). In these approaches, the frequency of extractions is increased significantly so that much more of the ions entering the TOF analyzer are extracted and hence much less of the ions are lost.

However, in these approaches there is an overlap between contiguous ion packets, which often contain a wide range of m/z ratios, and which may make mass assignment difficult or impossible. Proposed solutions to this problem attempt to "recover" the original spectra based on some kind of encoding of the pulsing sequence. For instance, the pulses may be triggered with certain pseudo-random delays that allow for the de-convolution of the resulting spectra. While reasonably good results have been demonstrated using such approaches, the de-convolution algorithms are not lossless and their effectiveness depends on the complexity of the original spectrum.

For example, spectra from complex biological samples often contain very high densities of peaks and are a challenge for such approaches.

Another practical limitation stems from the fact that the TOF extractor has to be operated at a fairly high frequency (extraction pulse rate). For a relatively short flight tube a frequency of up to, for example, 50 kHz or more may be needed. Even more critically, if one wanted to change the acquisition mode from multiplexed to normal, a significant change in extraction frequency would be required. This would lead to a variation in the extractor output and, consequently, a loss of resolution and mass accuracy. As a result, recalibration, as well as a long settling period, would be required before the analysis is continued.

Therefore, there is a need for providing better control over ions pulsed into a TOF analyzer.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a method for controlling ions in a time-of-flight mass spectrometer (TOF MS), the method includes: transmitting ions to an extractor; extracting at least some of the ions from the extractor into a flight tube, by applying an extraction voltage to the extractor at a multiplexed extraction pulse rate; and deflecting at least some of the ions by applying a deflection voltage to a deflector, wherein the deflected ions are prevented from reaching the detector and the non-deflected ions travel through the flight tube to a detector.

According to another embodiment, a method for controlling ions in a time-of-flight mass spectrometer (TOF MS) includes: extracting ions in extraction pulses from an extractor into a flight tube, by applying an extraction voltage to the extractor at an extraction pulse rate; and deflecting at least some of the extracted ions by applying a deflection voltage to a deflector at least once after applying the extraction voltage at least once, wherein the deflector is disposed in the flight tube proximal to the extractor, the non-deflected ions travel through the flight tube along a flight path to a detector, and the deflected ions travel away from the flight path without reaching the detector.

According to another embodiment, a time-of-flight mass spectrometry (TOF MS) system includes a controller communicating with the extractor and the deflector, and configured for performing all or part of any of the methods disclosed herein.

According to another embodiment, a computer-readable storage medium includes instructions for performing any of the methods disclosed herein.

According to another embodiment, a TOF MS system includes the computer-readable storage medium.

According to another embodiment, a TOF MS system includes: a deflector; a TOF analyzer including an extractor, a flight tube, and a detector, wherein the deflector is disposed in the flight tube proximal to the extractor; and a controller communicating with the extractor and the deflector, and configured for controlling extracting and deflecting.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
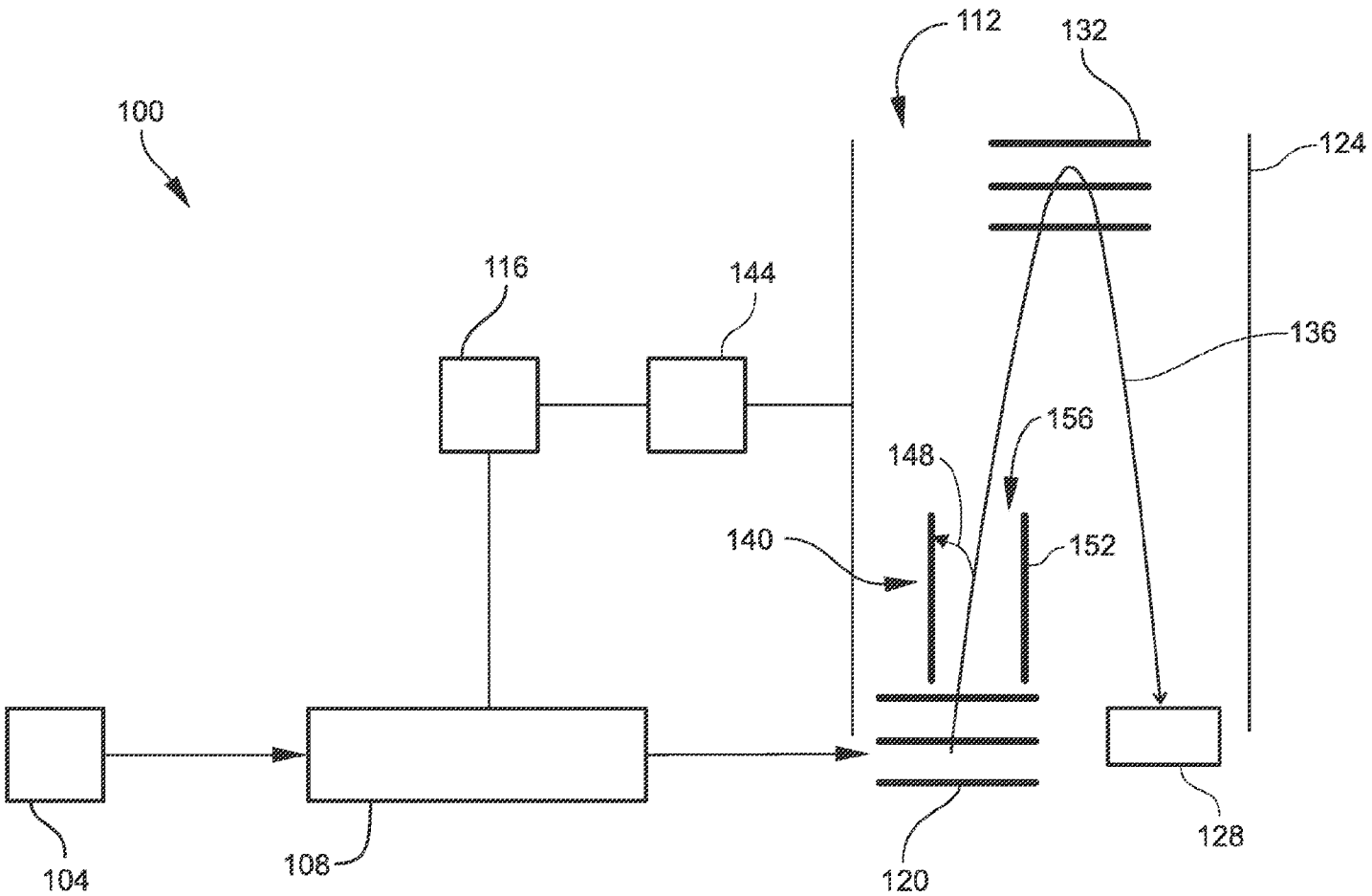
FIG. 1 is a schematic view of an example of a time-of-flight mass spectrometer (TOF MS) system that may be utilized in the implementation of methods described herein.

FIG. 1 is a schematic view of an example of a time-of-flight mass spectrometry (TOF MS) system 100 that may be utilized in the implementation of the subject matter described herein. The MS system 100 generally includes an ion source 104, an ion processing section 108, a time-of-flight (TOF) mass analyzer 112, and a system controller 116. The operation and design of specific components of TOF-based MS systems are generally known to persons skilled in the art and thus need not be described in detail herein. Instead, certain components are briefly described herein to facilitate an understanding of the subject matter presently disclosed.

The ion source 104 may be any type of continuous-beam or pulsed ion source suitable for MS operations. Examples of ion sources include, but are not limited to, electrospray ionization (ESI) sources, other atmospheric pressure ionization (API) sources, photo-ionization (PI) sources, electron ionization (EI) sources, chemical ionization (CI) sources, field ionization (FI) sources, laser desorption ionization (LDI) sources, and matrix-assisted laser desorption ionization (MALDI) sources. Depending on the type of ionization implemented, the ion source 104 may reside in a vacuum chamber or may operate at or near atmospheric pressure. Sample material to be analyzed may be introduced to the ion source 104 by any suitable means, including hyphenated techniques in which the sample material is the output of an analytical separation instrument such as, for example, a gas chromatography (GC) or liquid chromatography (LC) instrument (not shown).

The ion processing section 108 is a schematic representation one more ion processing components that may be included between the ion source 104 and the TOF analyzer 112 in accordance with the design of the TOF MS system 100, the type of sample to be analyzed, and the type of experiments to be conducted. Examples of ion processing components may include, but are not limited to, an interface with the ion source 104 for receiving ions therefrom, mass filters, ion traps, collision cells, multipole ion guides, various types of ion optics for focusing the ion beam and controlling the transport and energy of ions, an interface for admitting ions into the TOF analyzer 112, etc. Pressure in the ion processing section 108 may be controlled by one or more different vacuum stages.

The TOF analyzer 112 includes an ion extractor (or pulser) 120, a flight tube 124, and an ion detector 128. The ion extractor 120 includes a set of electrodes (e.g., grids or apertured plates) communicating with a voltage source for applying a pulsed electric field sufficient to extract ions from the ion extractor 120 into the flight tube 124. The flight tube 124 defines an electric field-free drift region through which ions drift toward the ion detector 128. The ion detector 128 may be any detector suitable for use in the TOF analyzer 112, a few non-limiting examples being an electron multiplier with a flat dynode and a microchannel plate detector (MCP). The ion detector 128 detects the arrival of ions (or counts the ions) and produces representative ion detection signals. In the present example, the TOF analyzer 112 is arranged as an orthogonal TOF MS—that is, the direction in which ions are extracted and drift through the flight tube 124 is generally orthogonal (or at least at an appreciable angle) to the direction in which ions are transmitted into the ion extractor 120. In this case, the TOF analyzer 112 may include a single- or multi-stage ion reflector (or reflectron) 132 that turns the path of the ions generally 180 degrees to focus their kinetic energy before their arrival at the detector 128, as appreciated by persons skilled in the art. The resulting ion flight path in this example is generally indicated at 136, also referred to herein as the main flight path. In other embodiments, the TOF analyzer 112 may be on-axis with the path of ions ejected from the ion processing section 108, in which case a reflector 132 is not utilized and the ion extractor 120 and detector 128 may be located at opposite ends of the flight tube 124. In the present embodiment the TOF analyzer 112 also includes an ion deflector 140, described further below.

The system controller 116 is schematically depicted as representing one or more modules configured for controlling, monitoring and/or timing various functional aspects of the TOF MS system 100 such as, for example, the ion source 104, various components of the ion processing section 108, the ion extractor 120, the ion detector 128, the ion deflector 140, a data recorder 144 (including, for example, one or more amplifiers and analog-to-digital converters), and vacuum pumps (not shown). The system controller 116 may also be configured for receiving the ion detection signals from the ion detector 128 and performing tasks relating to data acquisition and signal analysis as necessary to generate a mass spectrum characterizing the sample under analysis. The system controller 116 may include a computer-readable medium that includes instructions for performing any of the methods disclosed herein. For all such purposes, the system controller 116 is schematically illustrated as being in signal communication with various components of the TOF MS system 100 via wired or wireless communication links represented by lines. Also for these purposes, the system controller 116 may include one or more types of hardware, firmware and/or software, as well as one or more memories and databases. The system controller 116 typically includes a main electronic processor providing overall control, and may include one or more electronic processors configured for dedicated control operations or specific signal processing tasks. The system controller 116 may also schematically represent all voltage sources not specifically shown, as well as timing controllers, clocks, frequency/waveform generators and the like as needed for applying voltages to various components of the TOF MS system 100. The system controller 116 may also be representative of one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software, and devices for loading media readable by the electronic processor (e.g., logic instructions embodied in software, data, and the like). The system controller 116 may include an operating system (e.g., Microsoft Windows® software) for controlling and managing various functions of the system controller 116.

In the present embodiment, the ion deflector 140 is positioned in the electric field-free zone of the flight tube 124 at (i.e., at or proximate to) the ion extractor 120, i.e., on the "downstream" or output side of the ion extractor 120. The ion deflector 140 may have any configuration suitable for deflecting ions away from the main flight path 136 such the deflected ions instead travel along a deflection path 148. Consequently, the deflected ions do not reach the detector 128 and thus do not contribute to the spectrum recorded. Deflection may be implemented in one or more deflection pulses that are coordinated with one or more of the extraction pulses. The timing of activation of the deflector 140 relative to the operation of the extractor 120, and the duration of active operation of the deflector 140, may be controlled (e.g., by the controller 116) to provide various functions during the operation of the TOF analyzer 112.

For these purposes, the ion deflector 140 may include one or more deflector electrodes 152 (e.g., a cylinder, one or more plates, one or more cylindrical segments, etc.) positioned at (at or proximate to) the extractor 120. The deflector electrode(s) 152 may surround in whole or in part an ion deflection region 156 immediately downstream of the extractor 120. The deflector electrode(s) 152 may communicate with a voltage source (not specifically shown, but schematically represented by the controller 116) that applies a "deflection" voltage of opposite polarity to the deflector electrode(s) 152 (which may be done at a specified deflection pulse rate) and of sufficient magnitude to divert ions away from the main flight path 136. The magnitude (or absolute amplitude) of the deflection voltage may be significantly lower than the magnitude of the extraction voltage, and thus a relatively fast rise time may be easily achievable and the deflection operation may be easily controllable and not alter the performance of the extractor 120. In some embodiments, the magnitude of the deflection voltage may range from 5 to 30% of the magnitude of the extraction voltage. In some embodiments, the magnitude of the deflection voltage may range from about 100 to about 300 V while the magnitude of the extraction voltage ranges from about 1000 to about 2000 V. The course and direction of the deflection path 148 should be such as to avoid not only ion detection but also any potential contamination and charging of surfaces. To achieve this, the surfaces into which deflected ions fly may be positioned at a relatively far distance from the main flight path 136 and may be conductive, e.g., metal surfaces such as the deflector electrode surfaces themselves (as illustrated) or other surfaces outside the ion deflection region 156. To achieve good resolution while implementing the deflection operation, the deflector electrode(s) 152 may be configured such that the deflection region 156 is relatively small and localized so that ions in other positions along the main flight path 136 are not affected.

Figure 2:
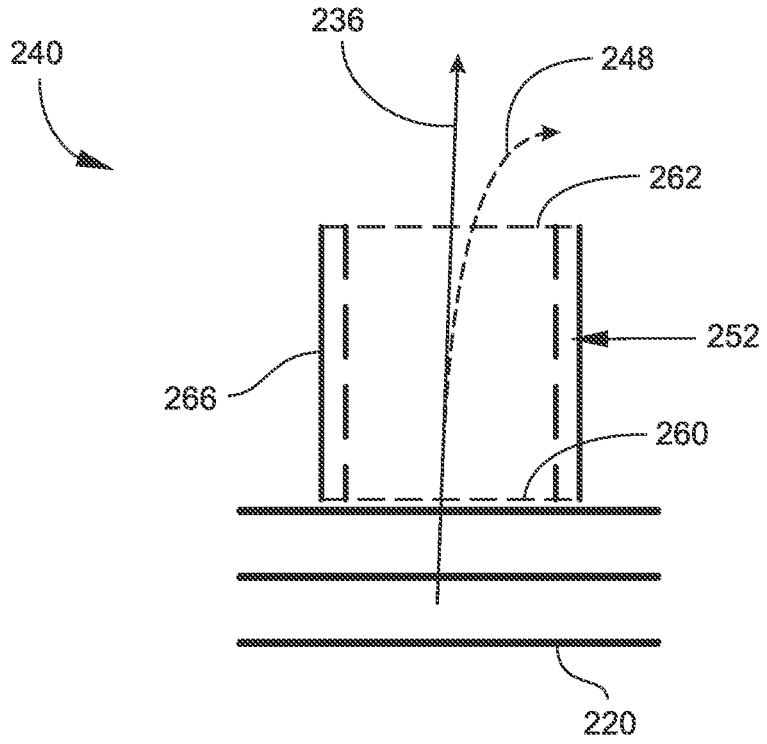
FIG. 2 is a schematic view of an example of an ion deflector according to some embodiments.

FIG. 2 is a schematic view of an example of an ion deflector (or ion deflector assembly) 240 according to some embodiments. The ion deflector 240 includes one or more deflector electrodes (or deflector plates) 252 defining a deflection region 256. In the illustrated embodiment, the electrodes 252 are spaced from each other along an axis orthogonal to the plates of an ion extractor 220. The individual electrodes 252 may or may not be independently energized at different deflection voltages, depending on the particular embodiment. The ion deflector 240 is positioned directly adjacent to the extractor 220, with just a small gap existing between the "lowermost" electrode 252 (from the perspective of FIG. 2) and the "uppermost" extractor plate. In some embodiments, the ion deflector 240 may be spaced from the extractor 220 by a distance ranging from 10 mm to 100 mm. The ion deflector 240 may include high transmission grids (or screens, or meshes) 260 and 262 respectively spanning the "inlet" and "outlet" of the ion deflector 240. The grids 260 and 262 may be useful for preventing penetration of the deflecting field into other regions of the TOF analyzer. The ion deflector 240 may also include an electrically conductive shield 266 surrounding the perimeter of the electrodes 252 to further isolate the ion deflector 240 in the TOF analyzer. FIG. 2 also schematically depicts a main flight path 236 taken by non-deflected ions and a deflected path 248 taken by deflected ions.

Figure 3:
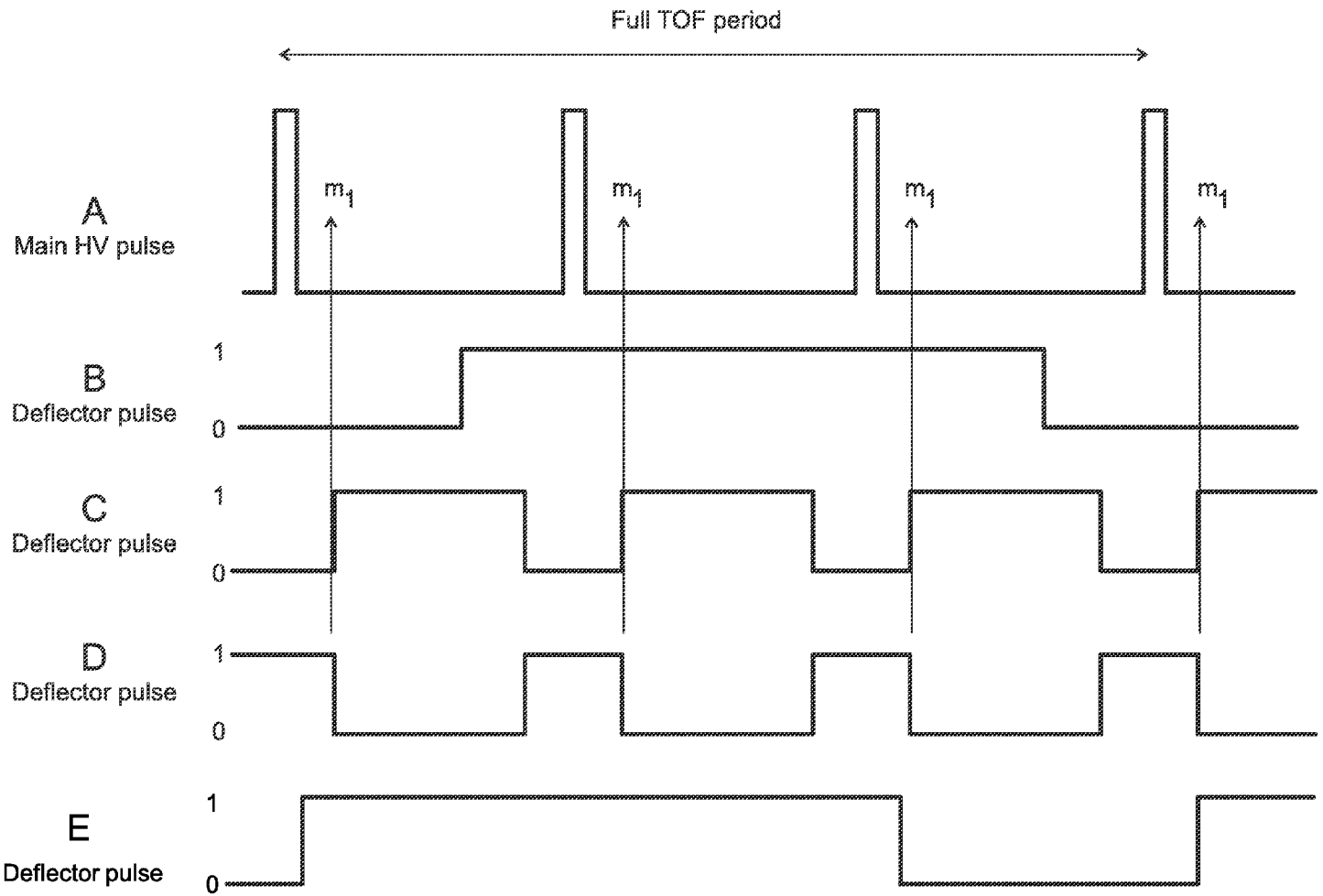
FIG. 3 is a set of timing sequences illustrating some examples of operating a TOF analyzer with an ion deflector as described herein.

FIG. 3 is a set of timing sequences illustrating some examples of operating a TOF analyzer (such as illustrated in FIG. 1) with an ion deflector as described above. Sequence A corresponds to the main high-voltage extraction pulses. In this example the extraction pulse rate or frequency is set to have a multiplexing factor of 3—that is, three extraction pulses occur over a full TOF scan period (as represented by a horizontal arrow above the extraction pulses). In the context of the present disclosure, a multiplexed extraction pulse rate (or "over-pulsing" rate) is a rate rapid enough to result in ions of more than one distinct ion packet in the TOF flight tube at the same time. For example, ions of a second ion packet may be extracted into the flight tube while ions of a previously extracted first ion packet have not yet arrived or fully arrived at the detector. As one non-limiting example, the multiplexed extraction pulse rate may range from 5 kHz to 50 kHz. Sequences B, C and D correspond to deflector pulses, which are either ON (state 1) or OFF (state 0). The ON and OFF states may respectively correspond to the application and non-application of a deflector voltage as described above.

Sequence B illustrates an example of utilizing the deflector to switch the TOF analyzer between the multiplexed mode of operation and a normal (non-multiplexed) mode of operation during a given TOF scan. The deflector is OFF during the first extraction pulse so that all ions pass to the detector. At some point (typically several microseconds) after the first extraction pulse, the deflector is turned ON for a long enough duration that ions from the two extraction pulses subsequent to the first extraction pulse are deflected and hence do not reach the detector. The deflector is turned back OFF before the fourth extraction pulse. The duration of deflection may be set, for example, so that ion packets corresponding to the first extraction pulse and subsequent fourth (or, more generally, nth) extraction pulse do not overlap in the flight tube.

Sequence C illustrates an example of utilizing the deflector as a low-pass mass filter, i.e., with an upper m/z ratio cutoff. The deflecting pulse is applied shortly after the first extraction pulse. The timing of the deflecting pulse relative to the first extraction pulse is such that ions with m/z ratios above a certain value ($m_1$) are not transmitted to the detector. The deflecting pulse may then be turned OFF just before the next extraction pulse, and this cycle may be repeated for all extraction pulses as desired.

Sequence D illustrates an example of utilizing the deflector as a high-pass filter, i.e., with a lower m/z ratio cutoff. The deflecting pulse is initially ON while the first extraction pulse is applied and turned OFF shortly thereafter. The timing of the deflecting pulse relative to the first extraction pulse is such that ions with m/z ratios below a certain value ($m_1$) are not transmitted to the detector. The deflecting pulse may then be turned back ON just before the next extraction pulse, and this cycle may be repeated for all extraction pulses as desired.

By operating the deflector in a m/z cutoff mode such as Sequence C or D, a part of the mass range of each extraction pulse is rejected. This may be useful when operating the extractor at a multiplexed pulse rate to increase the confidence of the spectrum recovery performed by a multiplexing algorithm, thereby resulting in higher sensitivity during a multiplexing operation.

Other embodiments may utilize a combination of sequences such as those illustrated in FIG. 3.

Figure 4:
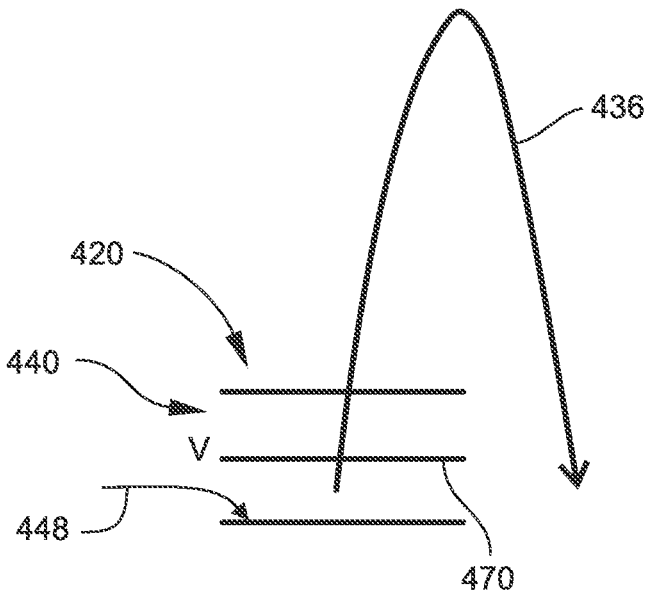
FIG. 4 is a schematic view of an example of an ion deflector according to another embodiment.

FIG. 4 is a schematic view of an example of an ion deflector 440 according to another embodiment. By example, the ion deflector 440 is shown positioned in relation to an ion extractor 420 and a main flight path 436 taken by non-deflected ions in an orthogonal TOF analyzer (not shown). In this embodiment, the ion deflector 440 may be characterized as being positioned at the ion extractor 420, or integrated with or part of ion extractor 420. Alternatively, the ion extractor 420 may be characterized as including the ion deflector 440, or as being configured for deflecting ions according to techniques disclosed herein, or as sharing one or more components with the ion extractor 420 such as one or more electrodes. In the illustrated embodiment, a middle electrode 470, e.g., an electrode between the uppermost and lowermost electrodes of the extractor 420 (so called puller and pusher electrodes, respectively) functions as a deflection electrode, and may be operated alternately as a deflection electrode and extraction non-deflection electrode. For example, the voltage (V) on the middle electrode 470 may be set to a value that causes all ions to be deflected and thus prevented from entering the extraction region. An example of an ion deflection path is illustrated by an arrow 448. If such a voltage is constantly applied then no ions would be extracted and detected. However, if this voltage is turned off only during the time period when ions are being accumulated before one of the extraction pulses, then only these ions will be extracted and detected. Finally, if such deflection voltage is permanently off, then the TOF instrument is operated in its regular mode and ions from all extraction pulses are detected. This approach therefore enables allowing ions from specific extractions to enter the flight tube. More specifically, it enables switching between normal and multiplexed modes of operation of the TOF MS system. Deflection and extraction may be carried out according to the time sequence shown in FIG. 3 (sequence E). More specifically, the deflection voltage is turned on right after the first extraction pulse and then turned off when the accumulation of ions starts for the next package of ions which is expected to be extracted and reach the detector.

Figure 5:
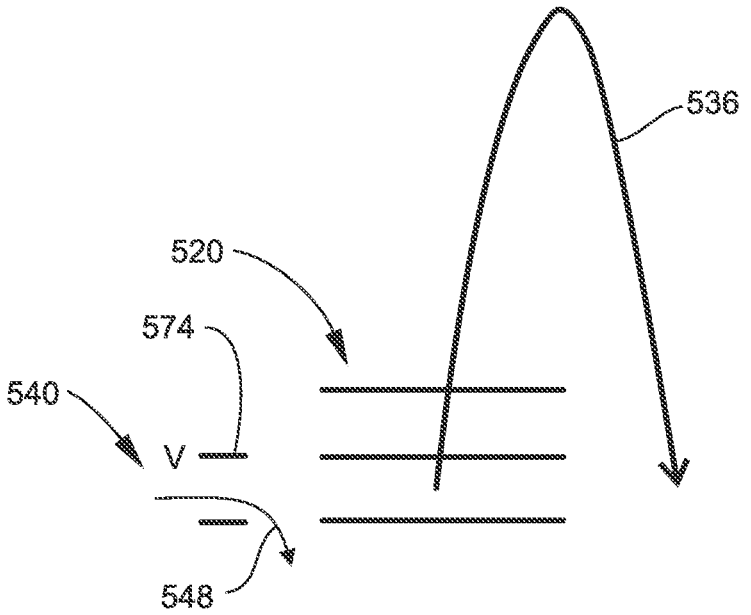
FIG. 5 is a schematic view of an example of an ion deflector according to another embodiment.

FIG. 5 is a schematic view of an example of an ion deflector 540 according to another embodiment. By example, the ion deflector 540 is shown positioned in relation to an ion extractor 520 and a main flight path 536 taken by non-deflected ions in an orthogonal TOF analyzer (not shown). In this embodiment the deflector 540 is positioned outside the TOF analyzer, before (or "upstream" of) the ion extractor 520. The deflector 540 may, for example, be a component of an ion processing section such as the ion processing section 108 schematically depicted in FIG. 1. Thus, the deflection of ions occurs before the extraction region by applying a deflection voltage (V) to one or more electrodes or optical elements of the deflector 540. The unwanted ion packets can be discarded by deflecting then away from the beam path or by applying a "stopping" potential to one or more electrodes so that ions cannot pass through the deflector 540. An example of an ion deflection path is illustrated by an arrow 548. One example of an optical element that may be used for this purpose is an ion slit with a voltage difference applied between top and bottom electrodes 574. The timing for such deflection voltage would then again allow for simple switching between normal and multiplexed modes of operation of the TOF MS system. Deflection and extraction may be carried out similar to the time sequence shown in FIG. 3 (sequence E). As in the previous embodiment, the deflection voltage is turned on after the first extraction pulse and then turned off when the accumulation of ions starts for the next package of ions which is expected to be extracted and reach the detector. However, in contrast to the embodiment with the deflection occurring inside the extractor, the onset of the deflecting voltage should occur slightly earlier than the exact moment of the main extractor pulse. This is to prevent the ions located between the deflector electrode and the extractor from entering the latter and being extracted in the subsequent extractor pulse.

As one non-limiting example of a method for controlling ions in a time-of-flight mass spectrometer (TOF MS), analyte ions may be produced from a sample, subjected to intermediate processes as called for by a particular procedure, and transmitted to the TOF analyzer. Ions are then extracted in extraction pulses from the extractor into a flight tube, by applying an extraction voltage to the extractor at a desired extraction pulse rate. At least some of the ions transmitted to the TOF analyzer are deflected by applying a deflection voltage to the deflector, which may be done in coordination with the timing of the extraction pulses. As described above, the ions may be deflected before reaching the extractor, or at the extractor (and without being extracted), or after being extracted. The non-deflected ions travel through the flight tube along a flight path to the detector and spectral data may be acquired in the normal manner, while the deflected ions travel away from the flight path without reaching the detector and thus do not form a part of the ion signal. To minimize loss of analyte ions, extraction may be carried out at a multiplexed pulse rate (i.e., over-pulsing). The deflector may be operated in cooperation with the extractor as described above to ameliorate any adverse effects resulting from multiplexing.

Methods entailing ion deflection in or before the TOF analyzer may be carried out, for example, in a system such as described above and illustrated in FIG. 1. One or more functions, operations or steps associated with the method may be implemented by hardware and/or software, including appropriate machine-executable instructions as may be stored on a computer storage medium. The computer storage medium may be interfaced with (e.g., loaded into) and readable by a computing device, which may be a component of (or at least in communication with) a suitable electronic processor-based device or system such as, for example, the controller 116 schematically illustrated in FIG. 1.

According to another embodiment, a TOF MS system is provided that includes a controller communicating with a TOF analyzer, and configured to perform any of the methods disclosed herein, or one or more steps of the methods. In the present context, the term "perform" encompasses actions such as controlling and/or signal or data transmission. For example, the controller may perform a method step by controlling another component involved in performing the method step. Performing or controlling may involve making calculations, or sending and/or receiving signals (e.g., control signals, instructions, measurement signals, parameter values, data, etc.). Non-limiting examples of a controller and associated system are described above and illustrated in FIG. 1.

According to another embodiment, a computer-readable storage medium is provided that includes instructions for performing (or controlling), in whole or in part, any of the methods disclosed herein. According to another embodiment, a TOF MS system is provided that includes the computer-readable storage medium.

According to another embodiment, a TOF MS system is provided that includes a TOF analyzer and a controller, non-limiting examples of which are described above and illustrated in FIG. 1. The TOF analyzer includes an ion extractor, a flight tube, and a detector. The TOF MS system also includes an ion deflector. The deflector may be positioned in the flight tube proximate to the extractor (e.g., FIG. 1 or 2), or may be positioned at or integrated with the extractor (e.g., FIG. 4), or may be positioned upstream of the extractor (e.g., FIG. 5). The controller (or hardware controlled by the controller, such as one or more voltage sources) communicates with the extractor and the deflector, and is configured for controlling extraction and deflection operations as described herein.

EXEMPLARY EMBODIMENTS

Exemplary embodiments provided in accordance with the presently disclosed subject matter include, but are not limited to, the following:

1. A method for controlling ions in a time-of-flight mass spectrometer (TOF MS), the method comprising: extracting ions in extraction pulses from an extractor into a flight tube, by applying an extraction voltage to the extractor at an extraction pulse rate; and deflecting at least some of the extracted ions by applying a deflection voltage to a deflector at least once after applying the extraction voltage at least once, wherein the deflector is disposed in the flight tube proximal to the extractor, the non-deflected ions travel through the flight tube along a flight path to a detector, and the deflected ions travel away from the flight path without reaching the detector.

2. The method of embodiment 1, comprising applying the deflection voltage at a magnitude ranging from 5 to 30% of a magnitude at which the extraction voltage is applied.

3. The method of embodiment 1 or 2, comprising, while extracting ions in extraction pulses, switching the deflector between a multiplexed mode and a normal mode, wherein: during the multiplexed mode, ions are extracted into the flight tube in a plurality of successive extraction pulses without being deflected; and during the normal mode, first ions are extracted into the flight tube in at least a first extraction pulse without being deflected, and additional ions are extracted into the flight tube in two or more extraction pulses following the first extraction pulse and are deflected such that the additional ions do not react the detector.

4. The method of embodiment 1 or 2, wherein extracting and deflecting comprise: extracting first ions into the flight tube in at least a first extraction pulse without being deflected; extracting additional ions in two or more intermediate extraction pulses following the first extraction pulse and deflecting the additional ions; and extracting nth ions into the flight tube in an nth extraction pulse following the intermediate extraction pulses without being deflected, wherein the first ions and nth ions travel through the flight tube without overlapping each other.

5. The method of any of embodiments 1-4, comprising, for ions extracted in at least one of the extraction pulses, timing the application of the deflection voltage such that only ions above or below a selected mass-to-charge ratio cutoff value reach the detector.

6. The method of any of embodiments 1-4, wherein extracting is done at a multiplexed extraction pulse rate and further comprising, for a plurality of successive extraction pulses, timing the application of the deflection voltage such that only ions above or below a selected mass-to-charge ratio cutoff value reach the detector.

7. A time-of-flight mass spectrometry (TOF MS) system, comprising a system controller communicating with the extractor and the deflector, and configured for performing the method of embodiment 1.

8. A computer-readable storage medium comprising instructions for performing the method of embodiment 1.

9. A time-of-flight mass spectrometry (TOF MS) system, comprising a time-of-flight mass spectrometer and the computer-readable storage medium of embodiment 8.

10. A time-of-flight mass spectrometry (TOF MS) system, comprising: a TOF analyzer comprising an extractor, a flight tube, a deflector, and a detector, wherein the deflector is disposed in the flight tube proximal to the extractor; and a controller communicating with the extractor and the deflector, and configured for controlling the following steps: extracting ions in extraction pulses from the extractor into the flight tube, by applying an extraction voltage to the extractor at an extraction pulse rate; and deflecting at least some of the extracted ions by applying a deflection voltage to the deflector at least once after applying the extraction voltage at least once, wherein the non-deflected ions travel through the flight tube along a flight path to the detector, and the deflected ions travel away from the flight path without reaching the detector.

11. The TOF MS system of embodiment 10, wherein the controller is configured for switching the deflector between a multiplexed mode and a normal mode.

12. The TOF MS system of embodiment 11, wherein: during the multiplexed mode, ions are extracted into the flight tube in a plurality of successive extraction pulses without being deflected; and during the normal mode, first ions are extracted into the flight tube in at least a first extraction pulse without being deflected, and additional ions are extracted into the flight tube in two or more extraction pulses following the first extraction pulse and are deflected such that the additional ions do not react the detector.

13. The TOF MS system of any of embodiments 10-12, wherein the controller is configured for controlling deflecting such that successive pulses of extracted ions do not overlap.

14. The TOF MS system of embodiment 13, wherein the controller is configured for: extracting first ions into the flight tube in at least a first extraction pulse without being deflected; extracting additional ions in one or more intermediate extraction pulses following the first extraction pulse and deflecting the additional ions; and extracting nth ions into the flight tube in an nth extraction pulse following the intermediate extraction pulses without being deflected, wherein the first ions and nth ions travel through the flight tube without overlapping each other.

15. The TOF MS system of any of embodiments 10-14, wherein the controller is configured for timing the application of the deflection voltage such that only ions above or below a selected mass-to-charge ratio cutoff value reach the detector.

16. The TOF MS system of any of embodiments 10-14, wherein the deflector is spaced from the extractor by a distance ranging from 10 mm to 100 mm.

17. A method for controlling ions in a time-of-flight mass spectrometer (TOF MS), the method comprising: transmitting ions to an extractor; extracting at least some of the ions from the extractor into a flight tube, by applying an extraction voltage to the extractor at a multiplexed extraction pulse rate; and deflecting at least some of the ions by applying a deflection voltage to a deflector, wherein the deflected ions are prevented from reaching the detector and the non-deflected ions travel through the flight tube to a detector.

18. The method of embodiment 17, wherein the non-deflected ions travel along a flight path to the detector, the deflector is disposed in the flight tube, and deflecting comprises deflecting at least some of the extracted ions such that the deflected ions travel away from the flight path.

19. The method of embodiment 17, wherein deflecting at least some of the ions comprises preventing the deflected ions from being extracted from the extractor.

20. The method of embodiment 19, wherein deflecting is done at the extractor.

21. The method of embodiment 20, wherein extracting comprises applying the extraction voltage to one or more electrodes of the extractor, and deflecting comprises applying the deflection voltage to at least one of the electrodes of the extractor.

22. The method of embodiment 19, wherein deflecting is done prior to transmitting the ions to the extractor.

23. The method of embodiment 22, wherein the deflector is positioned upstream of a TOF analyzer that includes the extractor and the flight tube.

24. The method of any of embodiments 17-23, comprising, while extracting ions in extraction pulses, switching the deflector between a multiplexed mode and a normal mode, wherein: during the multiplexed mode, ions are extracted into the flight tube in a plurality of successive extraction pulses without being deflected; and during the normal mode, first ions are extracted into the flight tube in at least a first extraction pulse without being deflected, and additional ions are deflected such that the additional ions do not reach the detector.

25. The method of embodiment 24, wherein during the normal mode, the additional ions are extracted into the flight tube in two or more extraction pulses following the first extraction pulse and are deflected subsequent to being extracted.

26. The method of embodiment 24, wherein during the normal mode, the additional ions are deflected at or upstream of the extractor such that the additional ions are not extracted into the flight tube.

27. The method of any of embodiments 17-26, wherein extracting and deflecting comprise: extracting first ions into the flight tube in at least a first extraction pulse without being deflected; deflecting additional ions such that the additional ions are not extracted into the flight tube by one or more intermediate extraction pulses following the first extraction pulse; and extracting nth ions into the flight tube in an nth extraction pulse following the intermediate extraction pulses without being deflected, wherein the first ions and nth ions travel through the flight tube without overlapping each other.

28. The method of any of embodiments 17-26, wherein extracting and deflecting comprise: extracting first ions into the flight tube in at least a first extraction pulse without being deflected; extracting additional ions in one or more intermediate extraction pulses following the first extraction pulse and deflecting the additional ions; and extracting nth ions into the flight tube in an nth extraction pulse following the intermediate extraction pulses without being deflected, wherein the first ions and nth ions travel through the flight tube without overlapping each other.

29. The method of any of embodiments 17-28, comprising timing the application of the deflection voltage relative to the application of the extraction voltage such that only ions above or below a selected mass-to-charge ratio cutoff value reach the detector.

30. A time-of-flight mass spectrometry (TOF MS) system, comprising a system controller communicating with the extractor and the deflector, and configured for performing the method of any of embodiments 17-29.

31. A computer-readable storage medium comprising instructions for performing the method of any of embodiments 17-29.

32. A time-of-flight mass spectrometry (TOF MS) system, comprising a time-of-flight mass spectrometer and the computer-readable storage medium of embodiment 31.

33. A time-of-flight mass spectrometry (TOF MS) system, comprising: a deflector; a TOF analyzer comprising an extractor, a flight tube, and a detector; and a controller communicating with the extractor and the deflector, and configured for controlling the following steps: transmitting ions to an extractor; extracting at least some of the ions from the extractor into a flight tube, by applying an extraction voltage to the extractor at a multiplexed extraction pulse rate; and deflecting at least some of the ions by applying a deflection voltage to a deflector, wherein the deflected ions are prevented from reaching the detector and the non-deflected ions travel through the flight tube to a detector.

34. The TOF MS system of embodiment 33, wherein the deflector is located at a position selected from the group consisting of: a position in the flight tube wherein the deflector is configured for deflecting ions after the ions have been extracted into the flight tube; a position at the extractor wherein the deflector is configured for deflecting ions such that the deflected ions are not extracted into the flight tube; and a position upstream of the extractor wherein the deflector is configured for deflecting ions such that the deflected ions are not transmitted into the extractor.

35. The TOF MS system of embodiment 33 or 34, wherein the controller is configured for switching the deflector between a multiplexed mode and a normal mode.

36. The TOF MS system of embodiment 35, wherein the controller is configured for:

during the multiplexed mode, extracting ions into the flight tube in a plurality of successive extraction pulses without being deflected; and during the normal mode, extracting first ions into the flight tube in at least a first extraction pulse without being deflected, and deflecting additional ions such that the additional ions do not reach the detector.

37. The TOF MS system of any of embodiments 33-36, wherein the controller is configured for controlling deflecting such that successive pulses of extracted ions do not overlap.

38. The TOF MS system of embodiment 37, wherein the controller is configured for: extracting first ions into the flight tube in at least a first extraction pulse without being deflected; deflecting additional ions such that the additional ions are not extracted into the flight tube by one or more intermediate extraction pulses following the first extraction pulse; and extracting nth ions into the flight tube in an nth extraction pulse following the intermediate extraction pulses without being deflected, wherein the first ions and nth ions travel through the flight tube without overlapping each other.

39. The TOF MS system of embodiment 37, wherein the controller is configured for: extracting first ions into the flight tube in at least a first extraction pulse without being deflected; extracting additional ions in two or more intermediate extraction pulses following the first extraction pulse and deflecting the additional ions; and extracting nth ions into the flight tube in an nth extraction pulse following the intermediate extraction pulses without being deflected, wherein the first ions and nth ions travel through the flight tube without overlapping each other.

40. The TOF MS system of any of embodiments 33-39, wherein the controller is configured for timing the application of the deflection voltage such that only ions above or below a selected mass-to-charge ratio cutoff value reach the detector.

It will be understood that FIG. 1 is a high-level schematic depiction of an example of a TOF MS system 100 consistent with the present disclosure. Other components, such as additional structures, vacuum pumps, gas plumbing, ion optics, ion guides and electronics may be included needed for practical implementations.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the system controller 116 schematically depicted in FIG. 1. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the system controller 116 in FIG. 1), direct the electronic system to carry out the instructions. The computer program product may be selectively embodied in any non-transitory computer-readable storage medium for use by or in connection with an instruction execution system, apparatus, or device, such as a electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program can be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for controlling ions in a time-of-flight mass spectrometer (TOF-MS), the method comprising: transmitting ions to an extractor; extracting at least some of the ions transmitted to the extractor into a flight tube as a plurality of successive ion packets, by applying an extraction voltage to the extractor at a multiplexed extraction pulse rate; deflecting at least some of the ions by applying a deflection voltage to a deflector; and timing the application of the deflection voltage relative to the application of the extraction voltage such that all ions from one or more entire ion packets of are deflected and prevented from reaching any detector and the non-deflected ions travel through the flight tube to a detector.

2. The method of claim 1, wherein the non-deflected ions travel along a flight path to the detector, the deflector is disposed in the flight tube, and deflecting comprises deflecting at least some of the extracted ions such that the deflected ions travel away from the flight path.

3. The method of claim 1, wherein deflecting at least some of the ions comprises preventing the deflected ions from being extracted from the extractor.

4. The method of claim 3, wherein deflecting is done at the extractor.

5. The method of claim 4, wherein extracting comprises applying the extraction voltage to one or more electrodes of the extractor, and deflecting comprises applying the deflection voltage to at least one of the electrodes of the extractor.

6. The method of claim 3, wherein deflecting is done prior to transmitting the ions to the extractor.

7. The method of claim 6, wherein the deflector is positioned upstream of a TOF analyzer that includes the extractor and the flight tube.

8. The method of claim 1, wherein extracting and deflecting comprise:

extracting first ions into the flight tube in at least a first extraction pulse without being deflected;

deflecting additional ions such that the additional ions are not extracted into the flight tube by one or more intermediate extraction pulses following the first extraction pulse; and extracting nth ions into the flight tube in an nth extraction pulse following the intermediate extraction pulses without being deflected, wherein the first ions and nth ions travel through the flight tube without overlapping each other.

9. The method of claim 1, wherein extracting and deflecting comprise:

extracting first ions into the flight tube in at least a first extraction pulse without being deflected;

extracting additional ions in one or more intermediate extraction pulses following the first extraction pulse and deflecting the additional ions; and extracting nth ions into the flight tube in an nth extraction pulse following the intermediate extraction pulses without being deflected, wherein the first ions and nth ions travel through the flight tube without overlapping each other.

10. The method of claim 1, comprising timing the application of the deflection voltage relative to the application of the extraction voltage such that only ions above or below a selected mass-to-charge ratio cutoff value reach the detector.

11. A time-of-flight mass spectrometry (TOF MS) system, comprising: a deflector; a TOF analyzer comprising an extractor, a flight tube, and a detector; and a controller communicating with the extractor and the deflector, and configured for controlling the following steps: transmitting ions to an extractor; extracting at least some of the ions transmitted to the extractor into a flight tube as a plurality of successive ion packets, by applying an extraction voltage to the extractor at a multiplexed extraction pulse rate; deflecting at least some of the ions by applying a deflection voltage to a deflector, and timing the application of the deflection voltage relative to the application of the extraction voltage such that all ions from one or more entire ion packets of the deflected ions are deflected and prevented from reaching any detector and the non-deflected ions travel through the flight tube to a detector.

12. The TOF MS system of claim 11, wherein the deflector is located at a position selected from the group consisting of:

a position in the flight tube wherein the deflector is configured for deflecting ions after the ions have been extracted into the flight tube;

a position at the extractor wherein the deflector is configured for deflecting ions such that the deflected ions are not extracted into the flight tube; and a position upstream of the extractor wherein the deflector is configured for deflecting ions such that the deflected ions are not transmitted into the extractor.

13. The TOF MS system of claim 11, wherein the controller is configured for switching the deflector between a multiplexed mode and a normal mode.

14. The TOF MS system of claim 13, wherein the controller is configured for:

during the multiplexed mode, extracting ions into the flight tube in a plurality of successive extraction pulses without being deflected; and during the normal mode, extracting first ions into the flight tube in at least a first extraction pulse without being deflected, and deflecting additional ions such that the additional ions do not reach the detector.

15. The TOF MS system of claim 11, wherein the controller is configured for controlling deflecting such that successive pulses of extracted ions do not overlap.

16. The TOF MS system of claim 15, wherein the controller is configured for:

extracting first ions into the flight tube in at least a first extraction pulse without being deflected;

deflecting additional ions such that the additional ions are not extracted into the flight tube by one or more intermediate extraction pulses following the first extraction pulse; and extracting nth ions into the flight tube in an nth extraction pulse following the intermediate extraction pulses without being deflected, wherein the first ions and nth ions travel through the flight tube without overlapping each other.

17. The TOF MS system of claim 15, wherein the controller is configured for:

extracting first ions into the flight tube in at least a first extraction pulse without being deflected;

extracting additional ions in two or more intermediate extraction pulses following the first extraction pulse and deflecting the additional ions; and extracting nth ions into the flight tube in an nth extraction pulse following the intermediate extraction pulses without being deflected, wherein the first ions and nth ions travel through the flight tube without overlapping each other.

18. A method for controlling ions in a time-of-flight mass spectrometer (TOF MS), the method comprising: transmitting ions to an extractor; extracting at least some of the ions from the extractor into a flight tube as a plurality of successive ion packets, by applying an extraction voltage to the extractor at a multiplexed extraction pulse rate; deflecting at least some of the ions by applying a deflection voltage to a deflector; and while extracting ions in extraction pulses, switching the deflector between a multiplexed mode and a normal mode, wherein: during the multiplexed mode, ions are extracted into the flight tube in a plurality of successive pulses without being deflected; and during the normal mode, first ion packet is extracted into the flight tube in at least a first extraction pulse without being deflected, an additional ion packets are deflected such that the additional ion packets do not reach the detector.

19. The method of claim 18, wherein during the normal mode, the additional ion packets are extracted into the flight tube in two or more extraction pulses following the first extraction pulse and are deflected subsequent to being extracted.

20. The method of claim 18, wherein during the normal mode, the additional ion packets are deflected at or upstream of the extractor such that the additional ions are not extracted into the flight tube.

* * * * *

UNITED STATES PATENT AND TRADEMARK OFFICE

CERTIFICATE OF CORRECTION

PATENT NO. : 9,029,763 B2
APPLICATION NO. : 14/015694
DATED : May 12, 2015
INVENTOR(S) : Michael Ugarov It is certified that error appears in the above-identified patent and that said Letters Patent is hereby corrected as shown below:

In The Claims

In column 14, line 38, in claim 1, delete "(TOF-MS)," and insert -- (TOF MS), --, therefor.

In column 14, line 46, in claim 1, after "packets" delete "of".

In column 15, line 40, in claim 11, delete "deflector," and insert -- deflector; --, therefor.

In column 15, line 43, in claim 11, delete "dpackets of the deflected ions" and insert -- packets --, therefor.

In column 16, line 45, in claim 18, after "successive" insert -- extraction --.

In column 16, line 48, in claim 18, delete "an" and insert -- and --, therefor.

Signed and Sealed this
Eighth Day of March, 2016

Michelle K. Lee

Michelle K. Lee
*Director of the United States Patent and Trademark Office*